United States Patent [19]

Randolph

[11] Patent Number: 4,789,091

[45] Date of Patent: Dec. 6, 1988

[54] UPHOLSTERY BUTTON DRIVER

[76] Inventor: Arthur J. Randolph, 1538 Chanate Rd., Santa Rosa, Calif. 95405

[21] Appl. No.: 114,007

[22] Filed: Oct. 29, 1987

[51] Int. Cl.[4] ..... B68G 7/08

[52] U.S. Cl. ..... 227/67; 29/91.4; 29/720; 29/809; 227/76

[58] Field of Search ..... 29/91.2, 91.4, 91.7, 29/91.8, 453, 720, 809; 112/80.05, 80.08, 80.16, 80.17; 227/18, 67, 76

[56] References Cited

U.S. PATENT DOCUMENTS

| | | | |
|---|---|---|---|
| 3,995,359 | 12/1976 | Randolph | 29/809 |
| 4,059,889 | 11/1977 | Randolph et al. | 29/809 X |
| 4,312,471 | 1/1982 | Randolph | 29/809 X |
| 4,368,566 | 1/1983 | Miller | 29/91.4 |
| 4,471,528 | 9/1984 | Miller | 29/91.2 |

*Primary Examiner*—P. W. Echols
*Assistant Examiner*—Andrew E. Rawlins
*Attorney, Agent, or Firm*—Alvin E. Hendricson

[57] ABSTRACT

A tufting machine feeds upholstered female and male button parts into drive mechanisms above and below a central table for receiving a cushion to be tufted. A retractable needle drive assembly forms an aperture through a cushion on the table along a drive axis of the machine, and, following retraction, a male button driver moves a male button part into the aperture and holds this button part on the drive axis while an upper drive mechanism drives a female button part onto the male button part to lock the parts together to complete a single tufting operation. Safety means prevent damage to elements and mechanisms of the tufting machine by possible malfunctioning or improper operation.

20 Claims, 10 Drawing Sheets

47
48
59
-4-
43
22
67
61
23
63
64
46
66
51
68
88
82
81
202
193
78
89
77
76
84
83
192
191
107
109
91
92
27
96
93
94
97
102
99
101
98
104
103

10
9
11
144
146
148
28
151
152
153
154
176
179
178
173
174
149
171
177
22
147
156
141
157
159
158
181
161
163
164
162
182
121
127
128
134
136
166
133
122
124
32
140

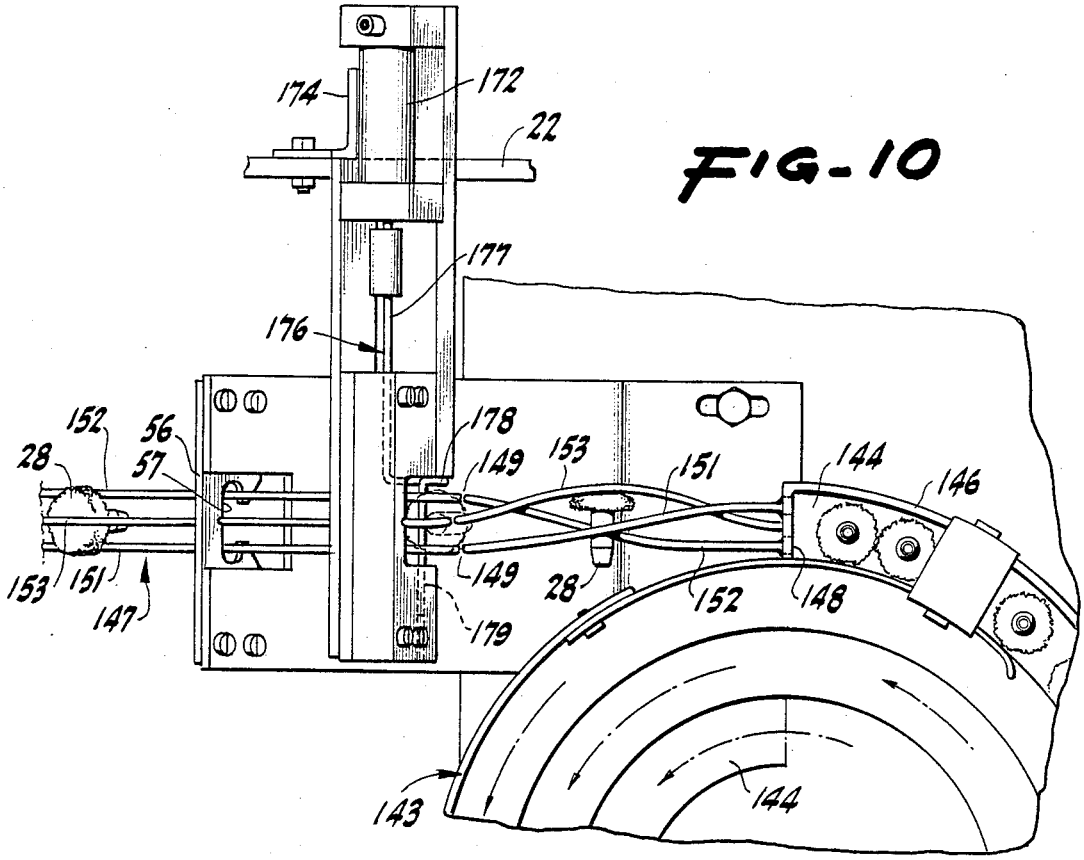
FIG-10
FIG-9
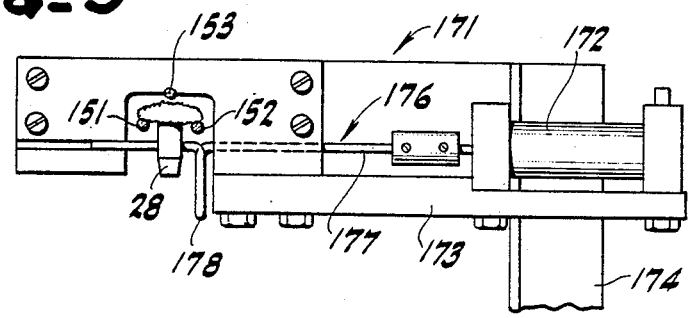
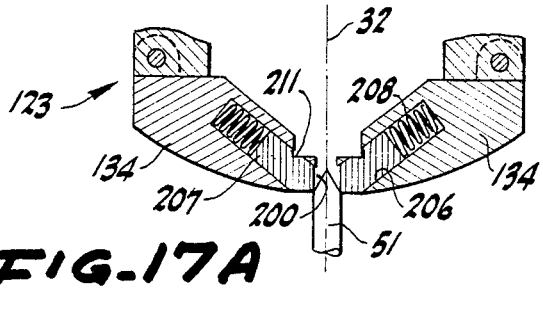
FIG-17A
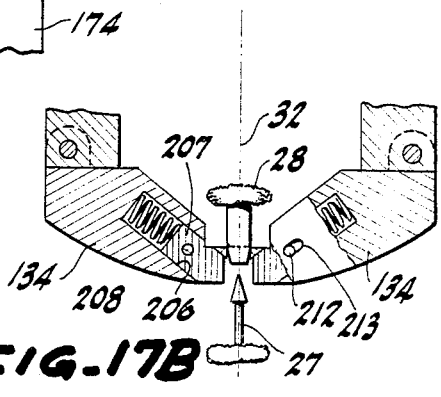
FIG-17B

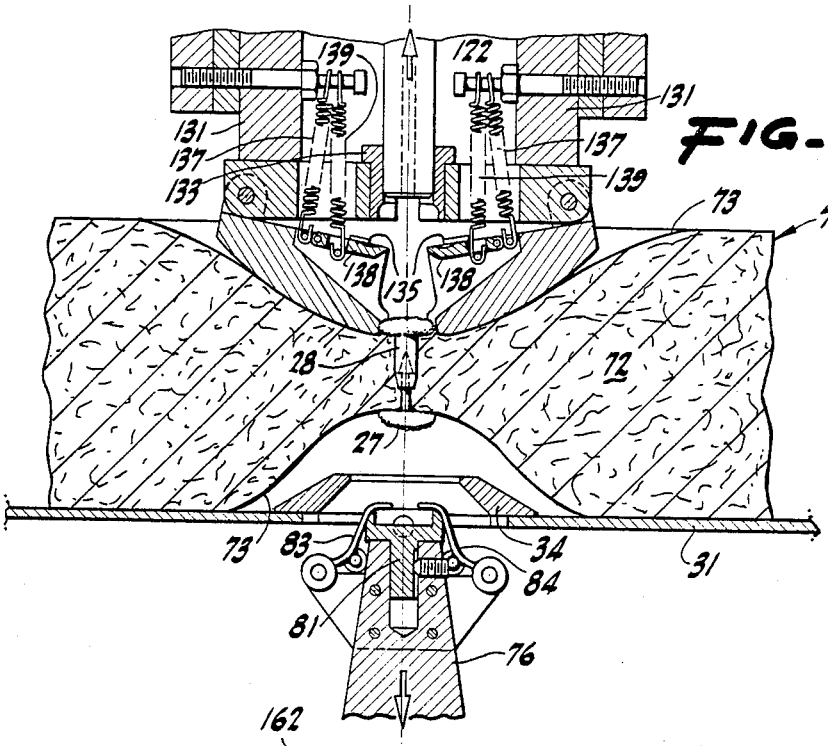
FIG-16
FIG-11
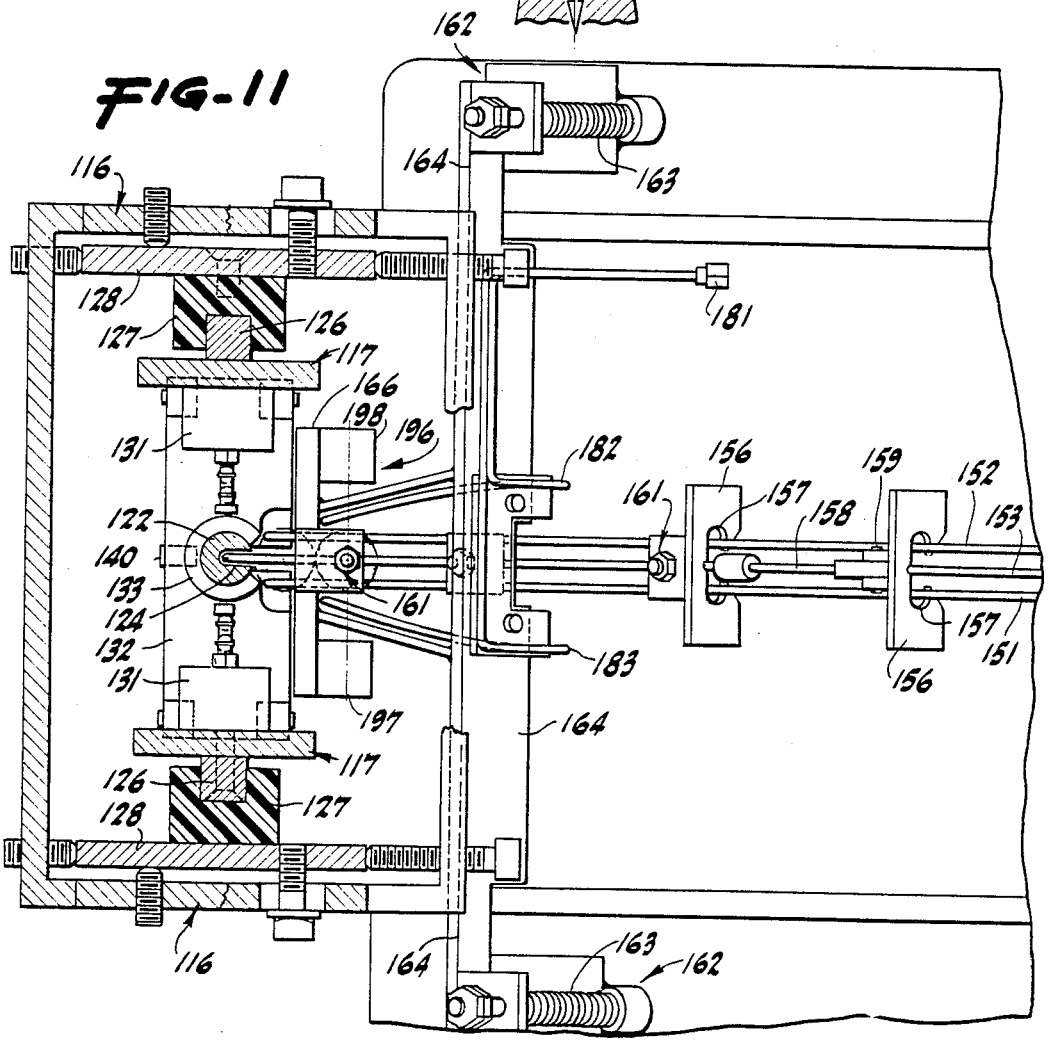

UPHOLSTERY BUTTON DRIVER

BACKGROUND OF THE INVENTION

Following the invention of the improved two part quilting button of U.S. Pat. No. 3,701,174, there have been developed a succession of automated or semi-automated quilting or tufting machines as shown in U.S. Pat. Nos. 3,995,359, 4,059,889, and 4,312,471. Such machines are adapted to rapidly and efficiently insert and lock together the two parts of the above-noted quilting button. These machines operate by extending a needle through the female button part with a point of the needle extending from the hollow shank of the female button part and driving this needle and part through a cushion to be quilted. The needle is then retracted and the male button part is driven into the female button part to lock the parts together in extension through the cushion or pad to be quilted. While this operation is highly advantageous for plastic button parts, it is not applicable to upholstered button parts. It will be appreciated that it is not possible to drive a needle through a button part that is upholstered across the head thereof, and the present invention is particularly directed to a machine for inserting upholstered button parts and locking same together for quilting or tufting operations.

SUMMARY OF INVENTION

The present invention provides a vertical machine having a transverse table centrally thereof for receiving a cushion or pad to be quilted or tufted. Above the table, there is provided a jaw mechanism disposed in a slide frame which is movable downward to engage and compress a cushion disposed on the above-noted table. Beneath the table, there is provided a retractable needle drive assembly operable to drive a needle upwardly through the aperture in the table and thence through the compressed pad or cushion thereon. Also beneath the table, there is provided a male button driver and a lower feed mechanism for inserting successive male buttons into the button driver. This male button driver is operable by a drive cylinder to move an upstanding male button part along a drive axis through the aperture formed by the needle, and to retain the button part in extension through the cushion. Above the table, there is provided a female button drive mechanism or button driver together with an upper feed mechanism for successively positioning individual female button parts with the shank thereof depending along the drive axis. By means of a drive cylinder, these female button parts are driven downwardly onto the male button part for locking the parts together. The upper and lower drive means are then retracted for a successive tufting or quilting operation.

It is to be appreciated that the button parts may have the heads thereof covered with various types of upholstery material, such material may vary from very smooth material such as plastic, or slick fabric, to very rough or even fuzzy materials. Particular attention is given herein to properly feeding and holding upholstered button parts wherein the upholstery material may tend to cling to parts of the machine or adjacent buttons, in order to ensure that the button parts are properly oriented for driving. Particular button feed means are herein provided to this end.

The present invention also includes various safety devices and internal checks to guarantee proper orientation of button parts at the time they are driven, and to preclude possible damage to elements or mechanisms of the tufting machine through improper or inadvertant operation or malfunctioning.

The tufting machine of the present invention provides rapid and positive tufting of a workpiece such as a cushion or pad with upholstered tufting or quilted buttons in at least a semi-automated operation that may, for example, be initiated for each tufting operation by a foot peddle or the like so that the hands of an operator are free to move a workpiece or pad on the table for proper alignment of same for each tufting operation.

BRIEF DESCRIPTION OF DRAWINGS

The present invention is illustrated with respect to a single preferred embodiment thereof in the accompanying drawing, wherein.

FIG. 9 is a transverse view of the upper button track taken in the plane 9—9 of FIG. 7 and showing the upper gate;

FIG. 10 is a partial plan view of the upper button feed mechanism taken in the plane 10—10 of FIG. 7;

FIG. 11 is a sectional view of the upper button feed mechanism and drive assembly taken in the plane 11—11 of FIG. 7;

FIGS. 12 through 16 are vertical sectional views illustrating the machine of the present invention in successive stages of operation, and FIGS. 17A and 17B are partial vertical view sectional views illustrating an alternative jaw arrangement allowing the use of an oversized needle for piercing particular types of cushions or the like.

DESCRIPTION OF PREFERRED EMBODIMENT

The present invention comprises a quilting or tufting machine for insertion of quilting buttons of the type disclosed in U.S. Pat. No. 3,701,174. Such a quilting button may be inserted by devices such as those shown in my prior U.S. Patents noted above, however, the present invention is directed to the insertion of buttons of this type having an upholstery material applied to the heads of the male and female parts of the button. Such upholstered quilting buttons cannot be inserted by driving a pin or needle axially therethrough because the heads are covered by a material and thus the present invention differs from the above-noted patented machines in various aspects, as will be noted below.

Figure 1:
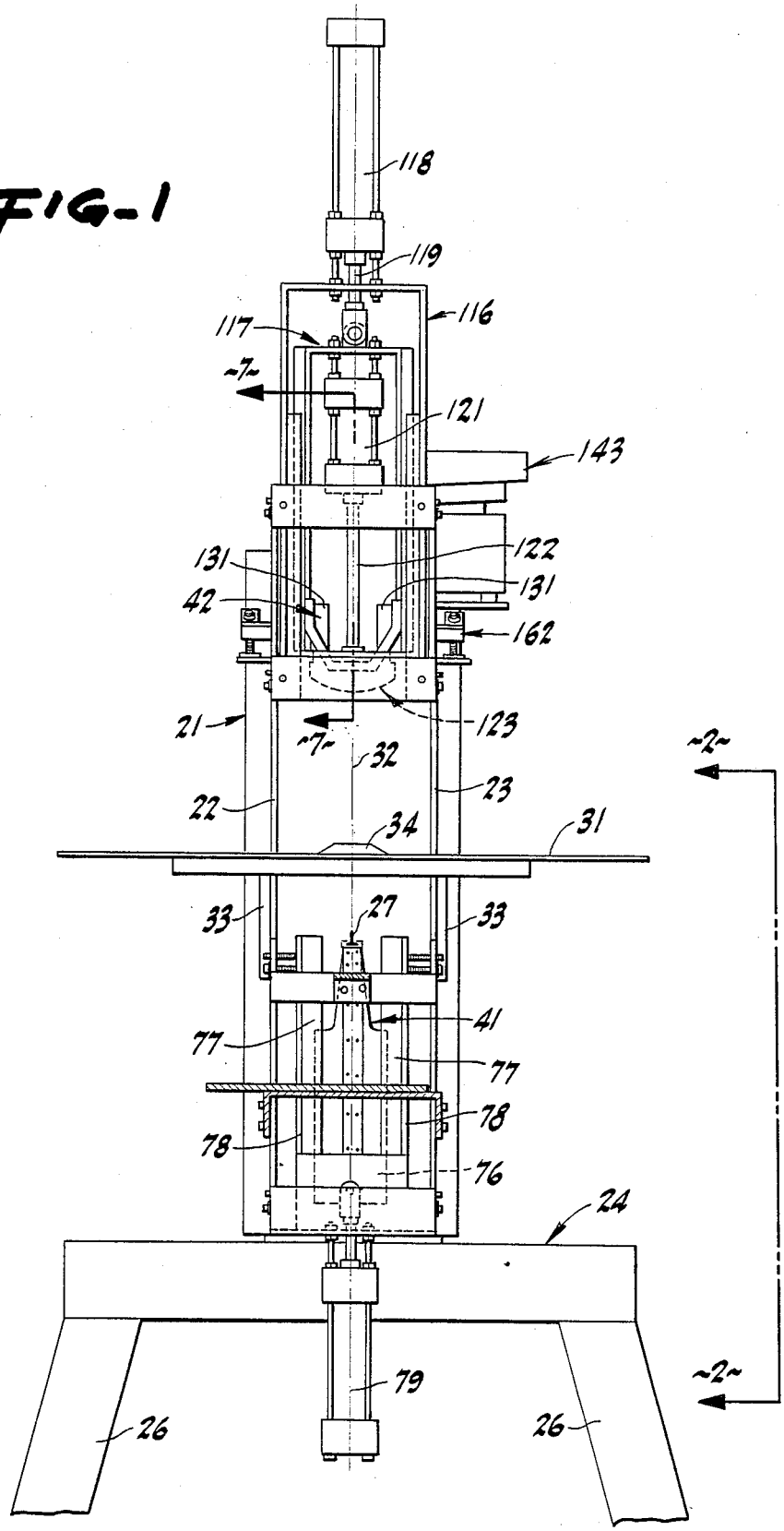
FIG. 1 is a front elevational view of an upholstery tufting machine in accordance with the present iventon.

Referring now to a preferred embodiment of the present invention generally illustrated at FIG. 1 of the drawings, it will be seen that the machine hereof includes a frame 21 having a pair of spaced apart vertical side plates 22 and 23 secured together and mounted upon a base 24 having depending legs 26. The side plates 22 and 23 of the frame are cut out or indented at the front of the frame whereat there is mounted a table 31 for supporting a workpiece such as a pad or the like to be quilted or tufted by the present invention.

Figures 4, 5, 6:
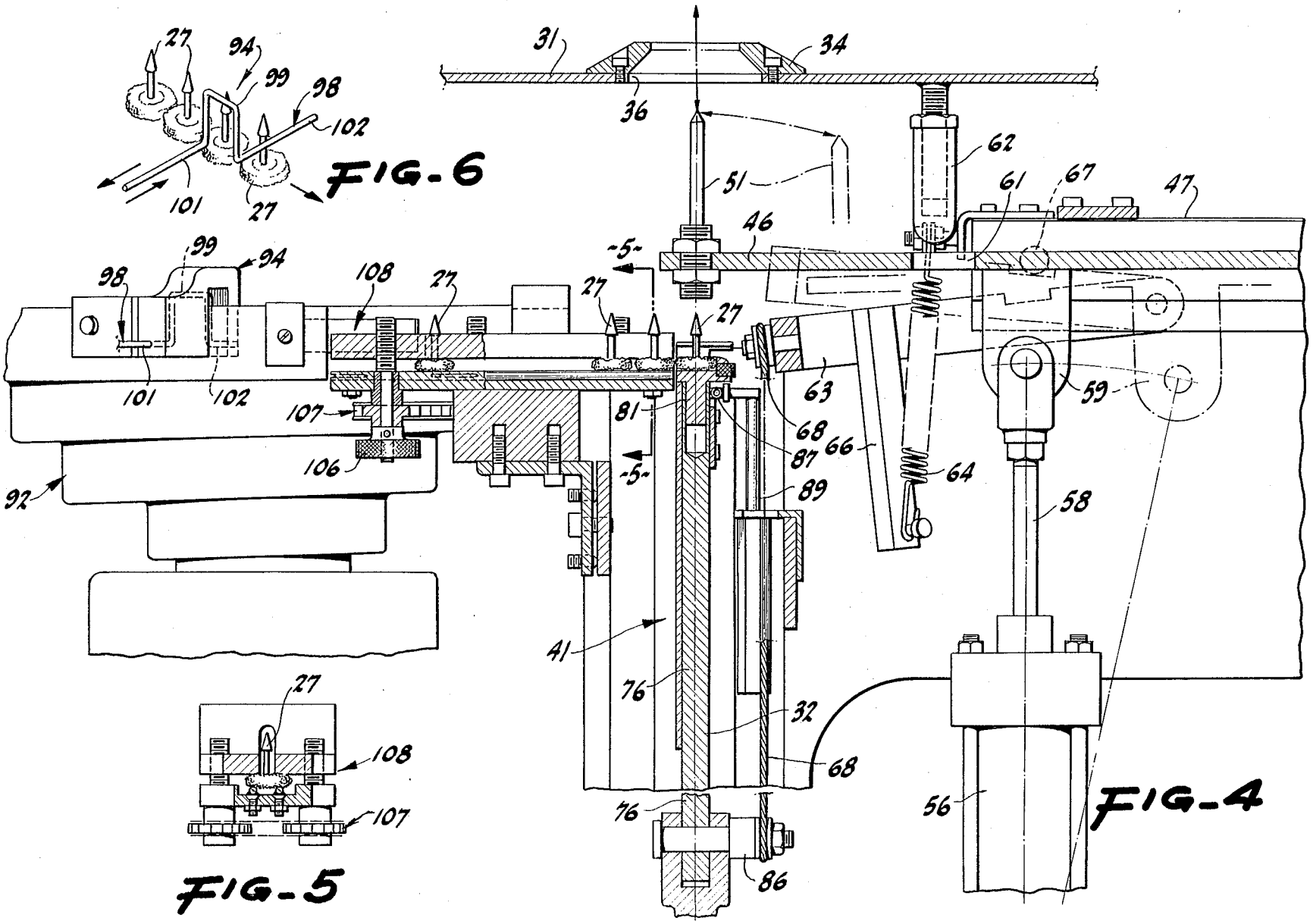
FIG. 4 is a vertical sectional view taken in the plane 4—4 of FIG. 3.
FIG. 5 is a partial sectional view taken in the plane 5—5 of FIG. 4.
FIG. 6 is a schematic illustration of a lower button gate indicating buttons feeding therethrough.
Figures 7, 8:
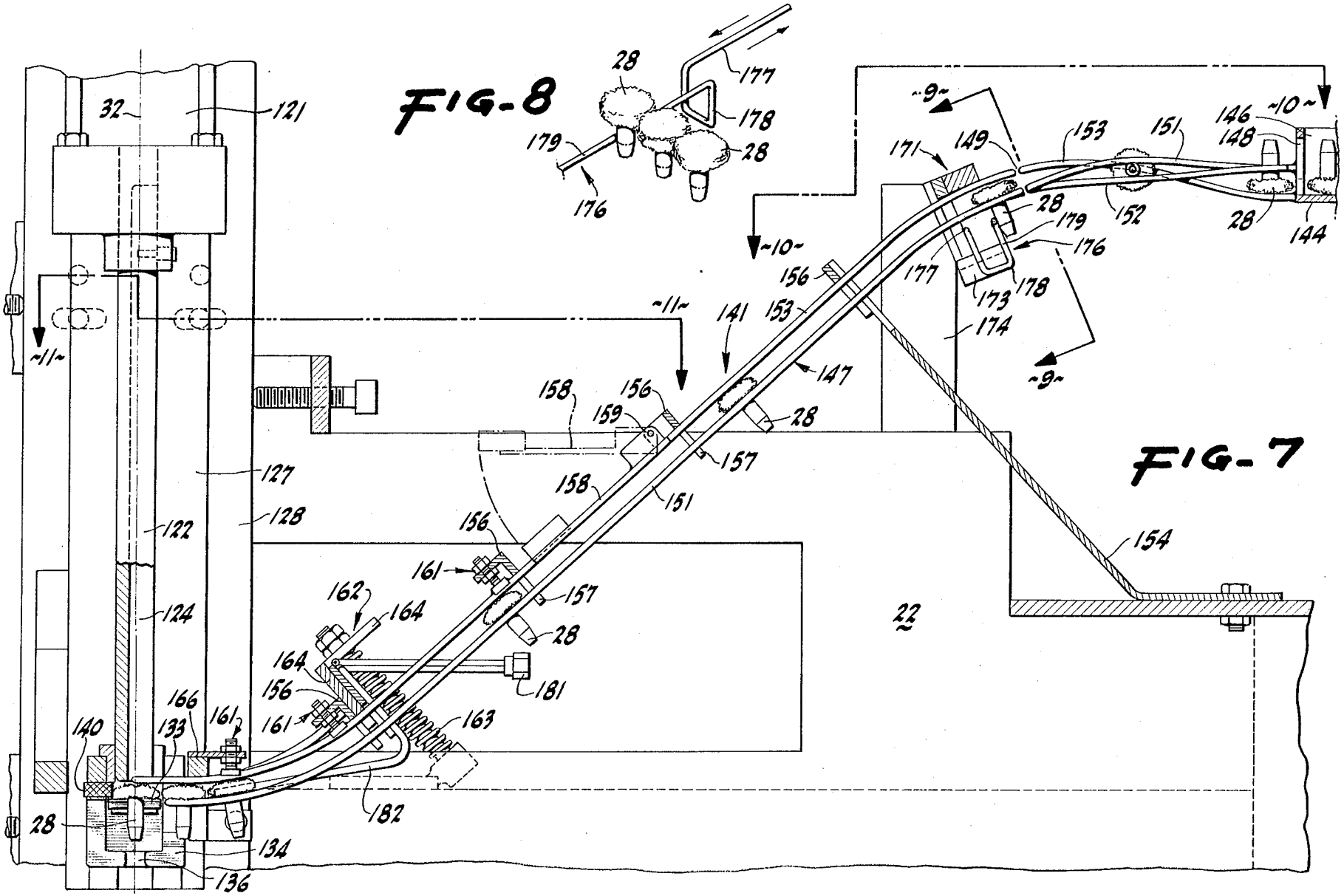
FIG. 7 is a central sectional view of the upper portion of the machine taken in the plane 7—7 of FIG. 1 and showing upper button feed mechanism.
FIG. 8 is a schematic illustration of the upper button gate indicating the mode of operation thereof the female button parts.

Before proceeding with a description of the present invention, it is first noted that the quilting button of my above-identified patent includes a male button portion 27 having a flanged head with an upstanding shank and an enlarged tapered end on the shank, as shown in FIG. 4. The button also includes a female button portion 28 as shown in FIG. 8, having a hollow cylindrical shank with a flanged head thereon and an internal shoulder within the hollow shank adapted to be engaged by the enlarged head on the shank of the male portion for locking the button portions together. The female button portion has a limited flexibility so that the male button portion may be driven therein to lock the button portions together. The foregoing button employed in the present invention has the heads of the male and female portions thereof upholstered or covered by upholstered material in conventional manner. In accordance with conventional practice the button heads thus have a thin metal sheet enveloping the heads and gripping edges of upholstery material beneath the head, with such material overlaying the entire button head. Such upholstery may vary from relatively smooth material such as a vinyl to fuzzy wool material or the like. Certain of these upholstery materials pose particular problems of handling the button parts during feeding and aligning same for quilting operations and these are further discussed below.

Beneath the table 31 there is provided a male button drive mechanism 41 and above the table 31 there is provided a female button drive mechanism 42, all mounted in the frame 21. There is also provided a needle drive unit 43 mounted in the frame below the table 31 and illustrated, for example, in FIGS. 2 and 3. The separate needle drive unit is required in the present invention to drive a hole through a workpiece such as a pad or the like to be quilted in order that the quilting button may be inserted through such pad.

Figure 2:
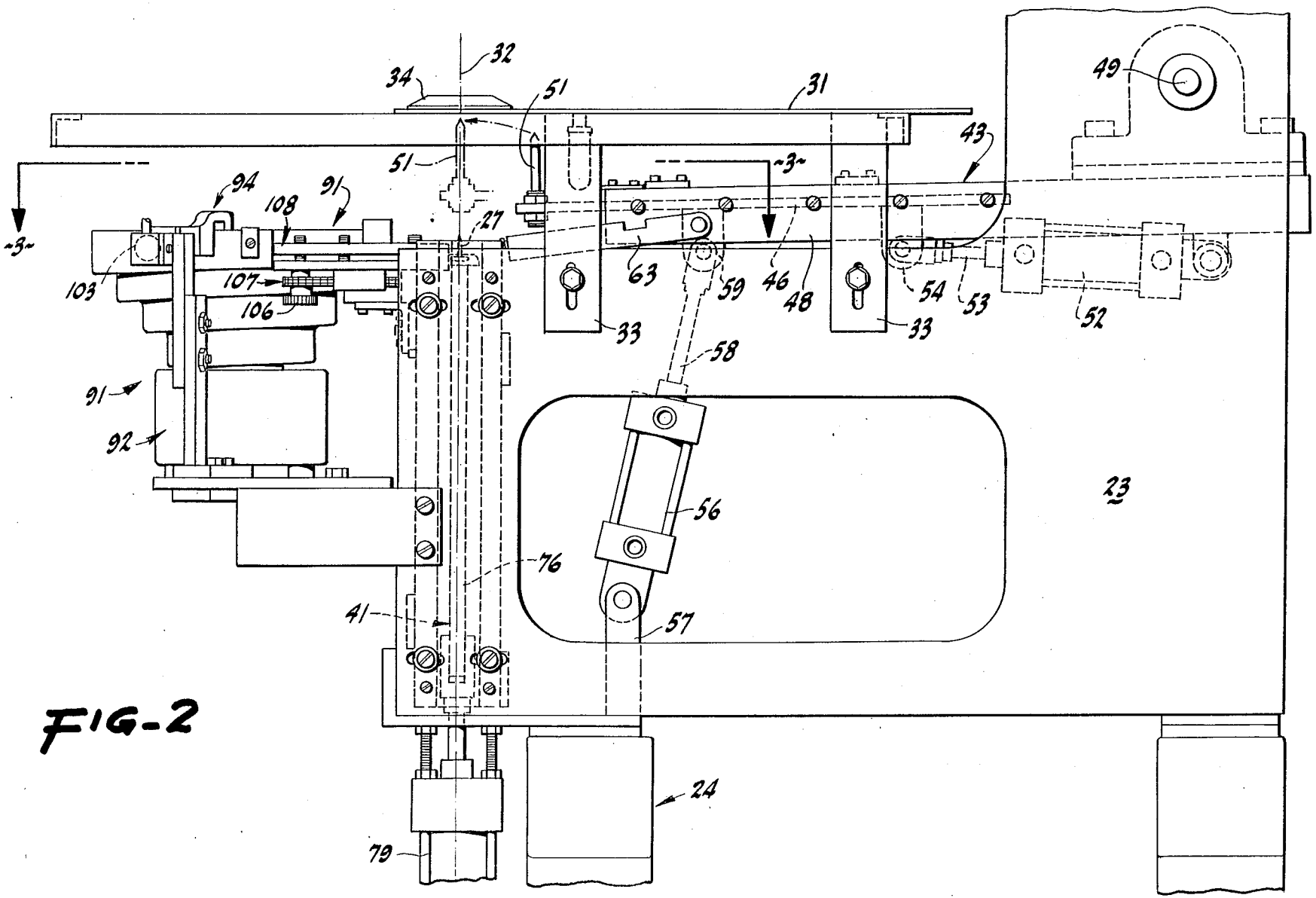
FIG. 2 is a side elevational view of the lower portion of the machine of FIG. 1, as indicated at 2—2 of FIG. 1.
Figure 3:
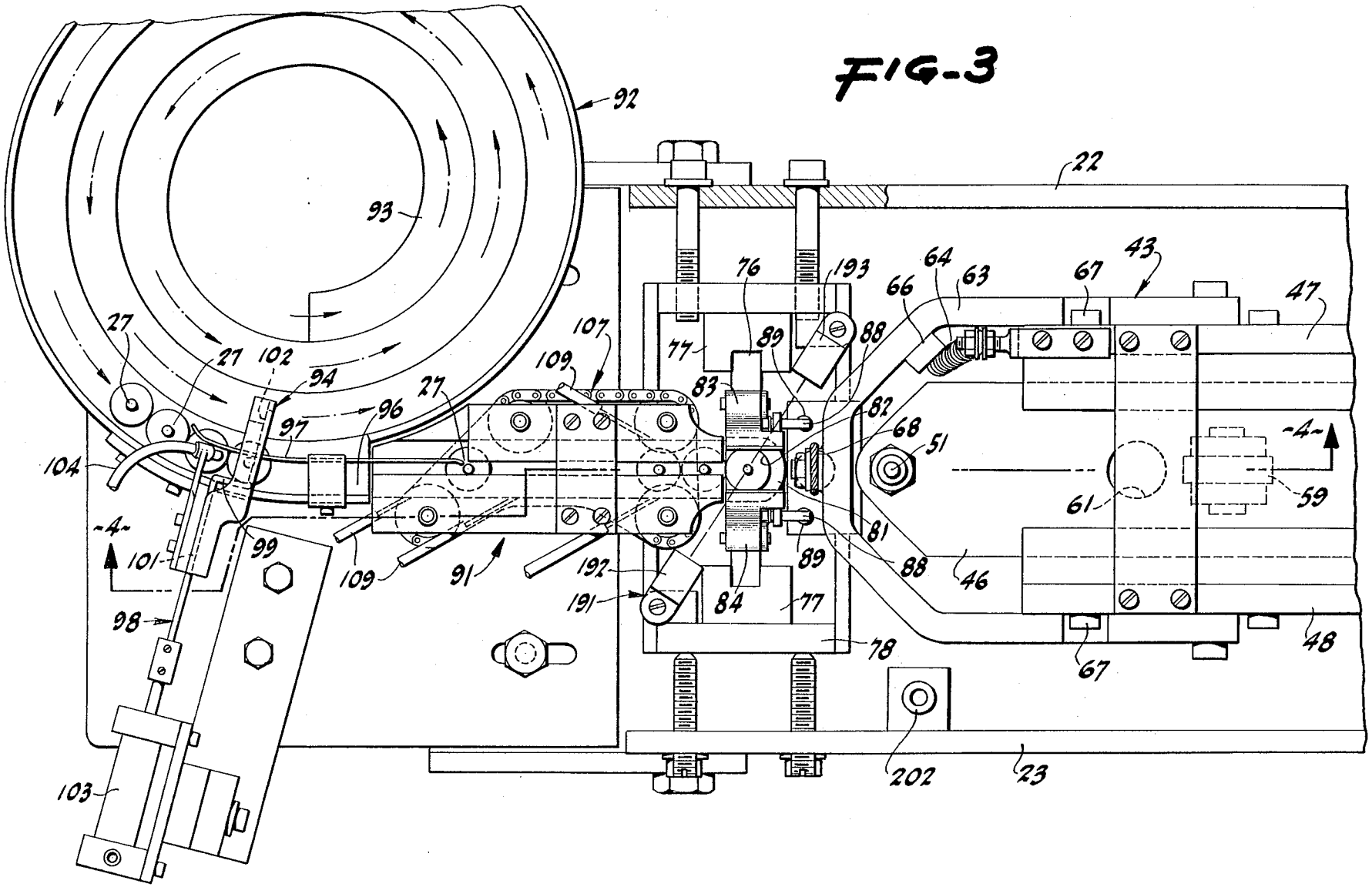
FIG. 3 is a plan view of the lower portion of the machine of FIG. 1 taken in the plane 3—3 of FIG. 2.

Considering first the needle drive unit 43 of the present invention, and referring, for example, to FIGS. 2, 3 and 4 of the drawings it will be seen that same is shown to include an elongated plate 46 slidably mounted between parallel arms 47 and 48 that are joined together at the rear thereof and pivotally mounted on a transverse horizontal shaft 49 in the frame 21. At the front of the plate 46, there is mounted a needle 51 extending vertically upward from the outer end of the plate. In the retracted position of the slide plate 46, as shown in FIG. 2, the vertical needle 51 is displaced rearwardly of the frame from a vertical drive axis 32 through table 31. Movable elements of the present invention are operated by drive means that may comprise hydraulic or pneumatic cylinders or electrically operated solenoids, and in the present embodiment these are referred to as drive cylinders. Movement of the slide plate 46 is controlled by a drive cylinder 52 mounted on the rear of arms 47 and 48 and having a piston rod 53 pivotably connected to a depending lug 54 on the slide plate 46. This drive cylinder thus serves to slide the plate 46, and thus the needle 51 thereon forwardly of the arms 47 and 48 into alignment with the vertical drive axis 32 and to retract the needle. There is also provided a drive cylinder 56 pivotably mounted on an arm 57 extending upwardly from the base 24. A piston rod 58 extends from the cylinder 56 upwardly into pivotal connection with a lug 59 depending from the slide plate 46.

Considering further the needle drive assembly 43, it is noted that the slide plate 46 is adapted to be moved by the drive cylinder 52 from a retracted position shown in FIG. 2, into an extended position shown in FIG. 4, and to be retracted therefrom. In addition, the needle 51 is adapted to be moved upwardly from the position of FIG. 4 through the table 31 to pierce or punch a hole in a pad or the like held upon the table, as further described below. It will be seen that the drive cylinder 56 is vertically oriented when the needle 51 is extended into extended or drive position so that actuation of the cylinder 56 will cause the needle to be moved substantially vertically upward in an arc about the mounting shaft 49 at the rear of the needle assembly arms 47 and 48. After the needle has been driven upwardly and then retracted by the drive cylinder 56, the piston rod 58 is locked in the retracted position so that retraction of the needle plate 46 by the drive cylinder 52 will cause the entire needle drive assembly to pivot downwardly as the piston rod 58 moves in an arc, as indicated in FIG. 2. The needle assembly in retracted position will thus be seen to be slightly inclined downwardly toward the front of the machine when the needle is retracted.

Certain safety arrangements are provided in connection with the needle drive assembly and thus, for example, there is provided an aperture 61 in the needle slide plate 46 which is adapted to align with a sleeve or cylinder 62 depending from the table 31 when the needle 51 is fully extended, as in the illustration of FIG. 4. Thus the needle may only be driven upwardly when the needle is aligned with the axis 32. In addition, there is provided a yoke 63 pivotally mounted at the rear open end thereof upon the assembly arms 47 and 48 and extending in a loop or arc across the front of the assembly ahead of the needle slide plate 46. In normal position this yoke prevents the needle slide plate 46 from being extended forwardly in order to prevent any possible untimely actuation of the needle slide assembly. A tension spring 64 is connected between a lug, attached to one of the slide assembly arms 47, and a pin on a bar 66 is attached to a side of the yoke 63. This tension spring 64 pulls the yoke upwardly into position across the front of the needle slide plate 46 and the yoke is prevented from further upward movement by engagement of a notch in the upper surface of the yoke with a side bolt 67 on a slide assembly arm 47. Provision is made for pivoting the yoke 63 downwardly out of alignment with the needle slide plate 46, as by means of a cable 68 extending about or attached to the front of the yoke 63 and extending downwardly into engagement with the portion of the lower button drive means 41, as further described below. This arrangement is provided to prevent inadvertant operation of the needle drive assembly when the lower button drive means 41 are actuated, again as further described in connection with the lower button drive means.

Considering further the table 31 of the present invention, it is noted that same is mounted between the lower button drive means 41 and the upper button drive means 42, as by means of depending brackets or legs 33 which may be adjustably mounted on the side plates 22 and 23 of the frame 21. This table 31 also includes an apertured frustoconical element 34 mounted atop the plate above an opening 36 in the plate with the vertical button or drive axis 32 extending centrally through the aperture of the member 34 and the plate aperture 36.

The table 31 is adapted to receive a workpiece such as a cushion, pad, or the like, 71 which may be disposed atop the table and which is to be quilted or tufted by the present invention. Such a cushion, or pad 71 as illustrated, for example, in FIG. 12 includes a central filler 72 having a cover 73 thereabout. The filler 72 may comprise a wide variety of different materials employed for upholstery and which in general is relatively resiliently compressible and the cover may comprise any type of upholstery covering material from plastic or leather to cotton, wool cloth or synthetic materials.

Figure 12:
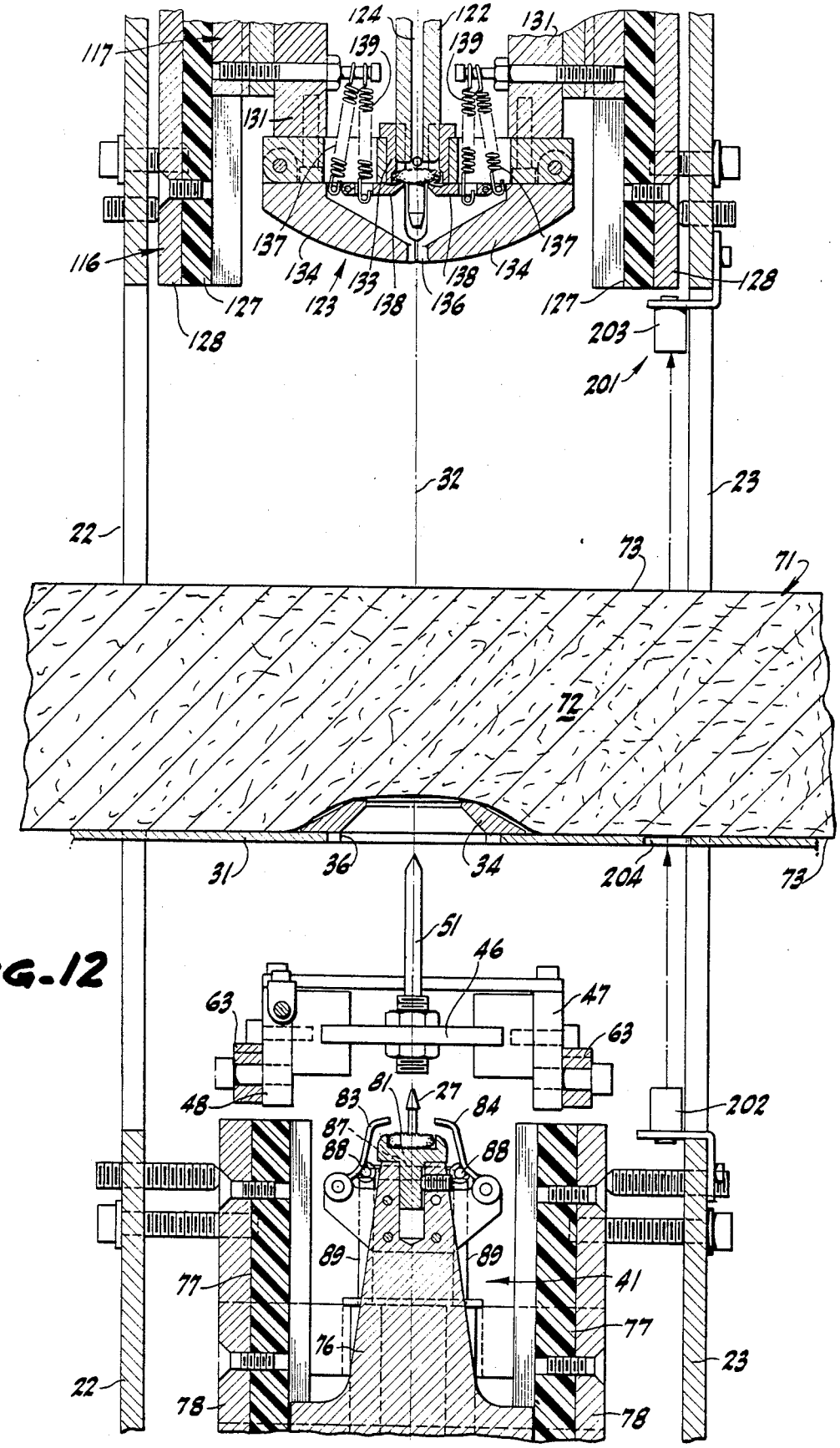
Figure 13:
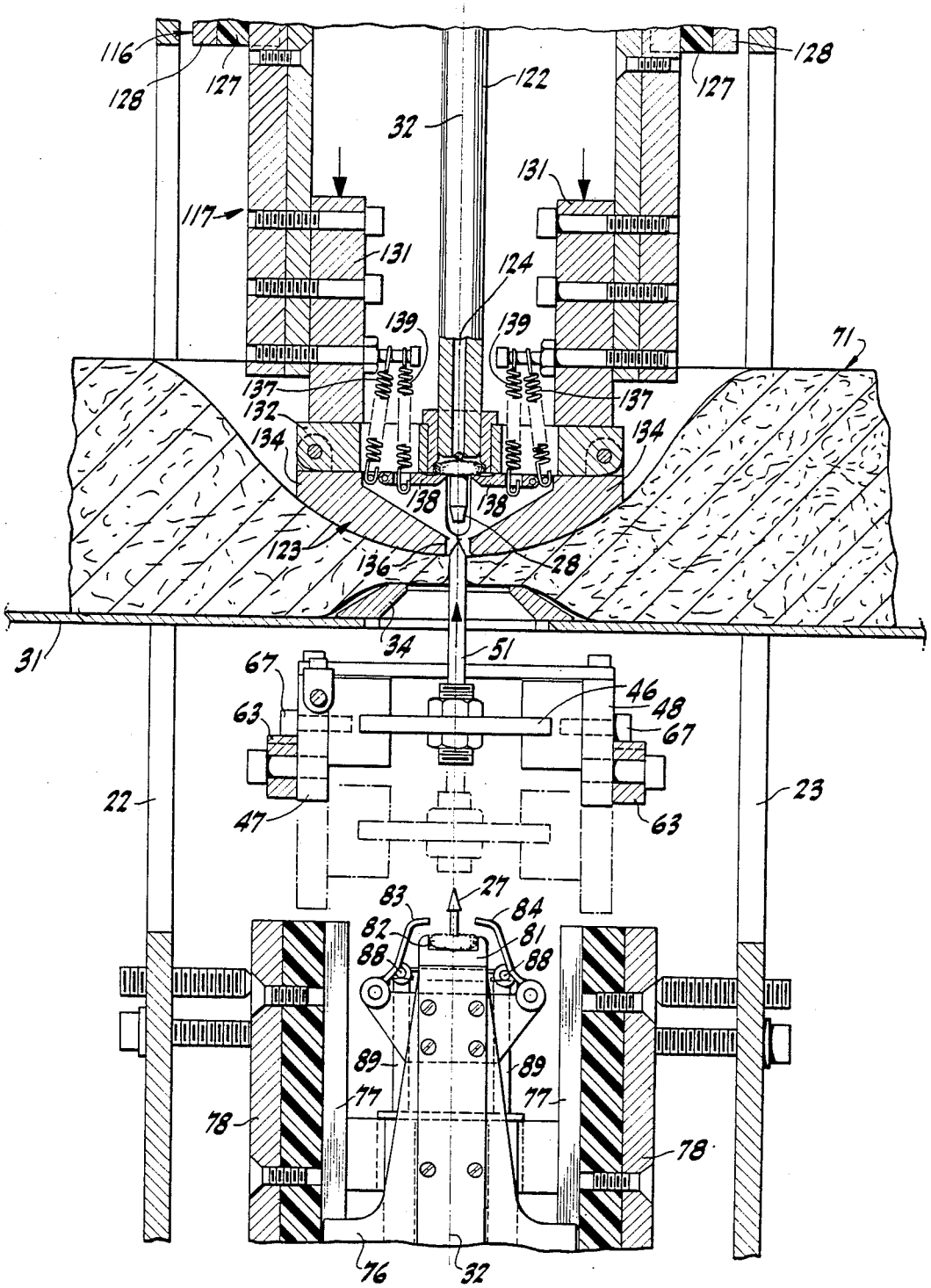
Figure 14:
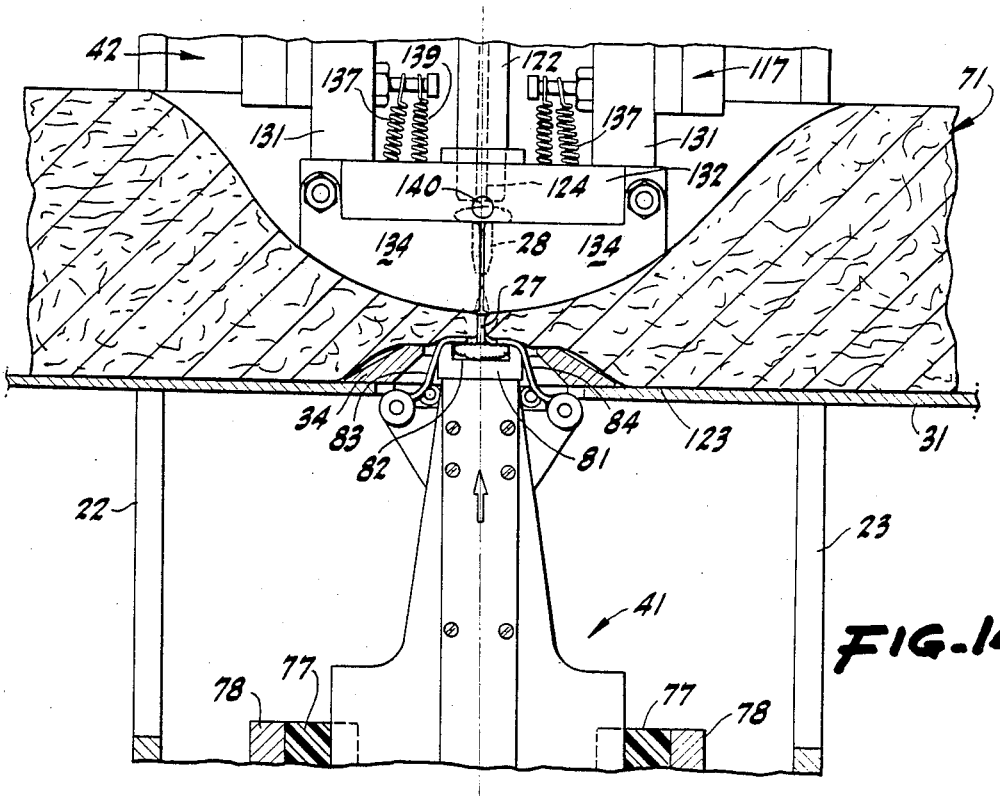

The lower drive mechanism 41 of the present invention, as shown in FIGS. 1 to 4, includes a vertical drive plate 76 slidably mounted in vertical rails 77 carried by a frame 78 that may be adjustably mounted between the side plates 22 and 23 of the main frame 21. This drive plate 76 is adapted to be driven vertically upward and downward by a drive cylinder 79 mounted on a lower cross piece of the main frame 21. The top of the drive plate 76 is tapered inwardly to a dimension less than the width of the openings in the table 31 and frustoconical element 34 thereon, and has a T-shaped element 81 inserted into a vertical aperture thereat. FIGS. 12 and 13 illustrate the upper structure of the drive plate 76 and attachments thereto, and it will be seen that the T-shaped element 81 is provided with a horizontal slot 82 having a curved inner end for receiving an upholstered male button part 27 with the shank thereof extending upward from the head of same. There is additionally provided atop the drive plate 76 an attachment including a pair of curved spring clips 83 and 84 which extend upwardly from side projections on the top of the plate 76 in a curve over the edges of the T-shaped element 81. The clips 83 and 84 are resiliently pulled together by a spring 87 extending between rods 88 attached to the clips 83 and 84. These rods 88 also extend rearwardly, as shown in FIG. 3, to engage stationary posts 89 on a fixed portion of the frame 78 when the drive plate 76 is fully retracted. Thus the spring clips are forced apart by engagement of rods 88 and posts 89 when the drive plate 76 is fully retracted so that a male button part may be inserted in the slot 82, as shown in FIG. 12. As the drive plate 76 is moved upwardly the rods 88 separate from the posts 89 so that the spring 87 pulls the clips together to grip the button part and hold it in position, as shown in FIG. 14. Operation of these clips are further discussed below in connection with the operation of the present invention.

It is noted further with respect to the lower drive mechanism 41, that a lateral extension 86 on the connection of the piston of the drive cylinder 79 and drive plate 76 is provided for connection of the cable 68 from the yoke 63 of the needle drive mechanism 43, as shown in FIG. 4. Thus, when the drive piston 79 is actuated to drive the drive plate 76 upwardly, the yoke 63 is drawn upwardly by the spring 64 to reside in the phantom position of FIG. 4 in front of the needle plate 46. This then prevents the needle 51 from being moved outwardly when the drive plate 76 is positioned upwardly from the position of FIG. 4. When this drive plate 76 is retracted into the position of FIG. 4, the yoke 63 is drawn downwardly by the cable 68 to move out of alignment with the needle drive plate 46, so that the needle drive assembly 43 may be operated.

Particular provision is made for feeding male button parts 27 into the lower button driver 41, and reference is made to FIGS. 2 through 6 illustrating such mechanism. The lower feed mechanism 91 includes a conventional vibration hopper 92 having an internal inclined ramp 93 along which male button parts 27 move to a gate 94, as shown in FIG. 3. It will be seen that the male button parts 27 move along the ramp 93 with the shanks of the parts extending upwardly, and the gate operates to pass individual button parts at spaced intervals onto a track 96 including an inverted T-shaped slot having a pair of wires along the bottom thereof and leading to the slot 82 in the top of the T-shaped element 81 of the drive plate 76 in retracted position of the latter. A curved bar 97 mounted above the track 96 is adapted to engage a side of a button shank and direct the button into the track slot.

The gate 94, which is schematically illustrated in FIG. 6, may be simply comprised as a wire or the like 98 having an inverted U-shaped portion 99 extending laterally between offset parallel portions 101 and 102. The gate 94 is spring loaded to move into the position illustrated in FIG. 6 and one of the parallel wires 101 of the gate is connected to a small drive cylinder 103 for controlled movement of the gate to the right in FIG. 6. It will be seen that powered operation of the gate to move the wire 98 thereof to the right in FIG. 6 will release the first button part to move along the track 96 while wire portion 101 prevents the next button part from moving onto the track. Spring retraction of the gate will release a second button part to move against the wire 102 and a third button part to move into engagement with the wire portion 101. Thus actuation of the gate to move back and forth will serially release single button parts to move along the track 96. Movement of button parts along the track is initiated by a small compressed air hose 104 directing a jet of air against the back side of the head of a male button part 27 retained by the gate wire 102.

The lower button feed means 91 also includes mean for maintaining the lower button part oriented with the shaft thereof directed upwardly, and mechanism is provided for adjusting vertical positioning of the button so that it will be fed into the slot 82 atop the vertical drive plate 76. Such mechanism is illustrated in part in FIGS. 4 and 5, wherein there will be seen to be provided a thumb wheel 106 operating a chain and sprocket arrangement 107 for raising or lowering adjusting mechanism 108 for directing male button parts in proper orientation and position for movement into the slot 82 atop the drive plate 76. Such adjusting mechanism may not be required in production models of the present invention. There are furthermore provided additional compressed air lines and nozzles 109 disposed along the path of the male button parts in the slot of the track 96 and directed at an angle thereto for moving such parts along the path thereof, as shown in FIG. 3.

The gate 94 and compressed air drive of the male button parts along the path thereof to the drive mechanism provides the present invention with the capability of handling button parts having substantially any type of upholstery material thereon. As noted above, some upholstery materials employed upon button parts may be quite rough and even fuzzy so that the button parts do not readily move along a predetermined path, but instead may stick together or to elements of the path, thus tipping the button part. In the present invention the gate 94 provides for metering individual button parts onto the desired path thereof to the drive mechanism, so that such parts move individually along the path upon the track 96 and beneath the upper plate of the adjusting means 108. One of the air jets 109 is directed to force the button part at the end of the path therefrom onto the top of the drive plate 76. By the foregoing, it is ensured that the upholstered button parts do in fact move successively from the vibratory hopper 92 onto the drive plate in desired orientation thereof.

Considering now the upper drive mechanism 42, same will be seen to include a rectangular frame 116 adjustably mounted on the main frame 21, and extending upwardly therefrom, as shown in FIG. 1 of the drawings. Within this upper frame 116, there is provided a slide frame 117 movable vertically therein by a drive cylinder 118 mounted atop the frame 116 and having piston rod 119 extending therethrough into engagement with the slide frame. Within the slide frame 117, there is disposed a vertical drive cylinder 121 mounted in depending relation to a top cross piece of the slide frame, and having a piston rod thereof secured to an axially depending drive rod 122 extending downwardly to and through jaw mechanism 123 mounted at the bottom of the slide frame 117.

Details of the upper drive mechanism 42 are best illustrated in FIGS. 1, 11 and 13, for example, and referring thereto it will be seen that the slide frame 117 has longitudinal projections 126 extending outwardly therefrom along the vertical sides of the frame, and slidably disposed in indentation in side rails 127 that in turn are mounted upon side plates 128 adjustably secured within the upper frame 116. At the bottom of the slide frame 117, there are provided a pair of blocks 131 secured to the inner surfaces of the slide and depending therefrom, and carrying a plate 132 across the bottom of the blocks with slot extending therein from the back side of the plate. A collar or bushing 133 extends through the center of the plate 132 and receives the lower end of the drive rod 122 in slidably relation therethrough. The collar or bushing 133 has a longitudinal slot in the back thereof aligned with the slot in plate 132 and an expanded opening at the bottom thereof to receive the head of a famale button part. A pair of jaws 134 are pivotably mounted on the plate 132 in depending relation therefrom, as particularly illustrated in FIG. 13, for example, and defining an opening 136 therebetween on the drive axis 32. This jaw mechanism 123 includes springs 137 holding the jaws 134 together and support plates 138 pivotally mounted on the jaws. The adjacent edges of the plates 138 define a slot having a width somewhat less than the diameter of the flanged end of a female button part, with the slot extending from the backside of the plates 138 into the aperture therebetween for movement of a female button part across the top of the plates into the alignment with the drive axis 32 of the machine. Springs 139 normally hold the support plates 138 upwardly against the underside of the plate 132 for receiving and supporting a female button part prior to driving of same. As shown in FIG. 16, small stops 135 on the side of jaws 134 engage the upper side of the pivot plates 138 to prevent the latter from being pulled upward beyond the top planes of the jaws 134 when the jaws are open so as to prevent possible jamming of the jaws in open position. By mounting the pivot plates 138 on the jaws 134 istead of on some fixed plate above the jaws, it is easier to clear buttons from the mechanism, if such should be necessary.

Operation of the upper drive mechanism 42 is further described in detail below, however, it is generally noted that the main drive cylinder 118 is adapted to move the slide frame 117 downwardly to engage the jaws 134 when a cushion or pad 71 is disposed on the table 31, and to compress this pad by the jaws 134 into the condition illustrated in FIG. 13, for example. The inner drive cylinder 121 is employed to drive the rod 122 downwardly after the slide frame has been moved downward to compress the pad 71, and thus to drive a female button part downward to engage a male button part.

The present invention also includes upper feed means 141 for the female button parts and such means are primarily illustrated in FIGS. 7 through 11. Considering again an upholstered female button part, it is to be realized that certain upholstery materials tend to cling to like materials on adjacent buttons, and also to prevent such upholstered buttons from readily moving along tracks or the like. Thus, the feed means shown in my prior U.S. Pat. No. 3,995,359 is not suitable for feeding buttons having certain types of upholstery material thereon. There is herein provided a particular type of mechanism for inverting female button parts and feeding such parts singly down an incline and into position for engagement with the drive rod 122, so that the button part may be driven through an aperture in a pad or cushion to be tufted. The upper feed mechanism 141 includes a conventional vibrating hopper 143 mounted on the frame 21 and has an internal ramp 144 spiraling thereabout, so that button parts placed within the hopper will move about the ramp to exit along a chute 146 atop the hopper. A particularly configured track 147 extends from the chute 146 in an incline downwardly to the drive axis 32 of the tufting machine. This track 147 extends outwardly from the chute and then curves downwardly to a straight inclined section having the bottom thereof gently curved into a horizontal portion extending to the underside of the drive rod 122.

The track 147 is formed of three wires or small rods, such as heavy stainless steel wires 151, 152 and 153. The main portion of the track 147 is supported by a bracket 154 and over the major portion of the track the wires thereof are parallel and are disposed in a triangular array, as shown in FIG. 9. The separation between the lower wires 151 and 152 is less than the diameter of the head of the female button part 28. Button parts 28 move along the chute 146 on the heads thereof with the shank of the button parts extending upwardly and yet it is necessary for the button part to be inverted for tufting operations. Thus, the wires of the track are particularly configured at the upper end, and in this respect reference is made to FIG. 7, wherein it will be seen that wires 151, 152 and 153 are attached to an apertured plate 148 across the end of the chute and are relatively twisted through an angle of 180°. As the button part 28 moves through an inverted T-shaped aperture in the plate 148 between the wires 151 and 152, they are vibrated in move along the wires and the button part will thus be rotated 180°, as shown in FIG. 7. The upper wire 153, also attached to the plate 148 at the end of the chute 146, extends from the bottom side of the chute in a curve to a position above the wires 151 and 152 after the plane of these wires have been rotated 180°. It will thus be seen that the button part is received by the track 147 and in movement therealong is inverted so as to be disposed with the head of the button part resting on the wires 151 and 152, and the wire 153 being disposed immediately above the head of the button part. The button part is thus retained against lateral motion and is retained on the track 147, and the only movement of the button that is possible is longitudinally of the track.

The track 147 is actually divided into two parts with the upper twisted part, described above, being mounted on the plate 148 which is attached to the end of the vibrating chute 146 so that the upper end of the track 147 is vibrated for moving successive button parts along the twisted portion thereof. The track is separated, as indicated at 149 of FIG. 7, with the wires of the upper portion of the track being separated from the wires of the lower by a short space as of the order one-sixteenth of an inch, and preferably the wires of the lower portion of the track are offset a very short distance below the corresponding wires of the upper portion as, for example, by an amount of one-thirty-second of an inch so that the button parts cannot hang up in crossing this separation 149.

The wires of the track are quite smooth so that the button parts readily slide down the inclined portion of the track. The wires of the track 147 are maintained in desired relationship to each other by spacers 156, which are best illustrated in FIGS. 10 and 11. These spacers comprise small plates having a central cutout 157 through which the wires of the track extend and this cutout is open at the bottom of the plate to provide a space for the shank of the button part moving along the track through the spacers 156. One of the spacers 156 is mounted on the support plate 154 and other spacers only engage the wires of the track. Provision may also be made for adjusting the height of the upper wire 153 above the lower wires 151 and 152 as indicated by the adjusting means 161 in FIG. 7. The lower wires 151 and 152 are attached to the spacers. The track 147 is also preferably provided with access means for removing a "bad" button therefrom. It is possible for a female button part to have a faulty covering, for example, so that button part can become jammed in the track along the inclined portion thereof and it would be difficult to remove such a button back up through the gate. Thus, the upper wire 153 has a short section 158 separated from the rest of the wire between a pair of spacers 156 with a hinge 159 at one end thereof and an extension 160 at the other end engaging the adjacent wire end so that this section 158 may be pivoted upwardly, as shown in phantom in FIG. 7, so that a button may be removed from the track.

At the bottom of the track, provision is made for mounting same upon the frame 21, and such mounting means 162 is shown to include a compression spring 163 urging a bracket 164 at an angle upwardly against a stop on the mounting means. A spacer 156 is attached to this bracket 164 for supporting the track. The spring loaded mounting means 162 and the resilient nature of the track 147 allows the track to be deflected downwardly to prevent inadvertent damage to the track during operation of the tufting machine, as further discussed below.

The lower end of the track 147 is directed into the jaw mechanism 123 with the lower wires 151 and 152 of the track being aligned with the upper surface of the pivotal support plates 138 of the jaw mechanism. The upper wire 153 of the track, however, extends further than the lower wires to the drive axis 32. The drive rod 122 has a longitudinal slot 124 in the rear thereof, and the upper track wire 153 extends into this slot 124. It will thus be seen that the female button part is deposited onto the support plates 138 of the jaw mechanism and retained in upright position thereon with the upper wire 153 holding the button part in such position. There is also provided a small magnet 140 extending through the front side of the collar 133 of the jaw mechanism, as shown in FIGS. 7 and 11, to hold a button in position to be driven. The magnet attracts the metal sheet on the button head beneath the upholstery covering and holds the button in a curved indentation in the bottom of the collar with the button shank aligned with the drive axis. The collar 133 may be formed of non-magnetic material to enhance the attractive force of the magnet. As an aside, it is noted that provision is made for preventing any rotation of the drive rod such as, for example, by attaching a bracket thereto with an apertured arm extending laterally therefrom and providing a fixed vertical shaft in sliding relation through the apertured arm, not shown. There is also preferably provide a further upper wire adjusting means 161 mounted on an apertured plate 166 adjacent to the jaw mechanism 123, as illustrated in FIGS. 7 and 11.

Provision is also made in the upper feed mechanism 141 for successively releasing female button parts so that they travel in spaced apart relation down the inclined portion of the track 147. Such means are provided as an upper gate 171 illustrated as to structure in FIGS. 7 and 9, and as to operate in FIG. 8. Such gate 171 includes a drive cylinder 172 mounted on a plate 173 that in turn is secured to a bracket 174 on the frame 21. The drive cylinder 172 has a wire 176 axially connected to the piston rod of the cylinder and which is formed in the same manner as the wire of the lower gate 96, but inverted. Thus, the wire 176 has a first straight portion 177 with a laterally extending U-shaped portion 178 connected to a second or outer straight portion 179 which will be seen to be parallel to the first straight portion 177 and laterally offset therefrom. This wire 176 is disposed below the track wires 151 and 152, and extends perpendicularly thereto beneath same. The wire 176 is carried in openings in a gate housing that has a central cut out portion through which the track extends.

Considering operation of the gate 171 and referring to FIG. 8, it will be seen that, with the wire 176 retracted to the right, the outer portion 179 will engage the depending shank of a female button part 28 carried by the track 147. Actuation of the gate by operation of the drive cylinder 172 will move the wire 176 thereof to the left in FIGS. 8 and 9, so that the U-shaped portion 178 is moved to the opposite side of the depending shank of the female button part and the first button part will be released to move down the track into engagement with the wire portion 177. Retraction of the wire 176 releases the first button part to slide down the track while the wire portion 179 moves to the right to prevent to next female button part from sliding down the track. Thus each cycle of extension and retraction of the gate 171 releases only one button part with the next part being retained for release during the next cycle of operation. The movement of the gate wire 176 may be accomplished by actuation of the drive cylinder 172 in forward and reverse direction, or the cylinder may be empolyed only to actuate the gate and a spring may be employed to return it to the original retracted position.

With regard to the movement of button parts along the track 147, it is noted that the wires 151, 152 and 153 of the track engage the chute 146 extending from the vibrating hopper 143. Thus, a button part 28 will be vibrated onto or into the track and inverted to move to and then through the gate 171 so as to slide down the inclined portion of the track 147. At the bottom of the track, provision is made for positively urging successive button parts into the jaws mechanism and, as illustrated, this may include a compressed air line 181 extending from the bracket 164 on said mounting means 162, and divided into a pair of flexible loops 182 and 183 terminating adjacent opposite sides of the lower end of the track, as is seen in FIG. 11.

In addition to the foregoing elements of the present invention, there are also provided certain indicating means as part of an overall safety system preferably forming a portion of the present invention. The tufting machine of the present invention operates to drive the needle 51 through a pad or the like for forming an aperture therethrough, and this is herein accomplished with the application of a very large force to the needle. Consequently it is important to ensure that the entire path of the needle 51 is clear before the needle drive mechanism is operated. To this end there is provided the yoke 63 and control therefore, as described above, is order to prevent any possible extension of the needle drive 46 when the entire path of movement of the needle is not clear. Additionally, there is provided hereby sensing means for determining the presence of a male button portion 27 in position to be driven by the drive plate 76, and such means are shown in FIG. 3 at 191 to comprise, for example, a photocell 192 and light source 193 secured to the frame 78, and having a line of sight intersecting the upstanding shaft of a male button part extending axially upwardly along the drive axis 32 from the drive plate 76. This sensing means thus not only identifies the presence of a male button part atop the drive plate 76, but also identifies the proper orientation of this male button part with the axis of the shank thereof aligned with the drive axis 32. This sensing means 191 thus is employed to produce an enabling signal for operation of the machine and to prevent operation in the absence of a properly oriented and aligned male button part on the drive plate 76.

In addition to the particularly constructed feed means for the male and female button parts, as described above, it is also noted that the upper female button track 147 is spring mounted by the mounting means 162 so as to prevent damage thereto by any possible malfunctioning of the upper button drive means. There are also provided upper sensing means 196 including a photocell 197 and light source 198 mounted on the plate 166 adjacent to the rear of the jaw mechanism 122 and having a line of sight therebetween intersecting the depending shank of a female button part 28 disposed adjacent to the bottom of the upper track 147. This upper sensing means 196, thus identifies the presence of a button at the bottom of the track 147, and produces a signal preventing operation of the machine in the absence of a button identified by such sensing means.

A further safety feature provided in the present invention are sensing means 201 comprising a vertically oriented collimated light source 202 and photocell 203 having a line of sight therebetween extending through an aperture 204 in the table 31. These sensing means 201 may be mounted interiorly of the plate 23 of the main frame 21, and operate to sense the presence of a cushion or pad 71 upon the table 31 so as to prevent operation of the tufting machine in the absence of such a cushion.

It will be seen from the foregoing description that most, if not all, of the mechanisms of the present invention are shown to be mounted for adjustable positioning and alignment and at least some of these adjusting means are not particularly described inasmuch as they may not be required in the production version of the present invention. It is, however, noted that particular alignment and relationship of elements of this machine are quite important, as will become more apparent from the following description of operation of the present invention.

Operation of the present invention is primarily illustrated in FIGS. 12 through 16, and referring thereto it will be seen in FIG. 12 that a cushion or pad 71 is disposed upon the table of elements of the machine. With the lower button drive plate 76 retracted downwardly, a male button part 27 is moved from the hopper 92 through the gate 94 and along the path 96 into the slot 82 atop the drive plate 76. Operation of the lower feed means 91 has been described above, however, it is noted that the yoke 63 of the needle drive assembly 43 is pivoted downwardly as shown in FIG. 4 and the sensing means 191 identifies the presence of the male button part with the shank in position to be driven along the axis 32.

A female button part 28 is fed by the upper feed mechanism 141, in the manner described above, into position with the head thereof resting upon the pivotal support plates 138 of the jaw mechanism 123. The female button part is maintained in this position by the upper wire 153 of the track 147 extending into the slot in the drive rod 122. This is the condition of the machine illustrated in FIG. 12, and the tufting operation is initiated by actuating the upper drive cylinder 118 to lower the slide frame 117 in the rails 127 to force the jaw mechanism 123 downwardly to compress the cushion 71 into the condition illustrated in FIG. 13. This drive cylinder 118 may, for example, have an eight inch stroke. The needle drive assembly is then actuated to operate the drive cylinder 52 for moving the needle 51 into alignment with the drive axis 32, and the drive cylinder 56 is subsequently actuated to pivot the drive plate 46 and the needle 51 thereon upwardly substantially along the drive axis 32 to force the needle 51 through the compressed portion of the cushion 71, as shown in FIG. 13. The needle is then automatically retracted by the drive cylinder 56 and the needle assembly is moved back from the drive axis by actuation of the drive cylinder 52, as indicated, for example, in FIG. 2. It is to be noted that the upward motion of the needle 51 is sufficient to pierce the cushion by the needle and to extend the point of the needle into the opening between the jaws 134 of the upper jaw mechanism 123.

Figure 15:
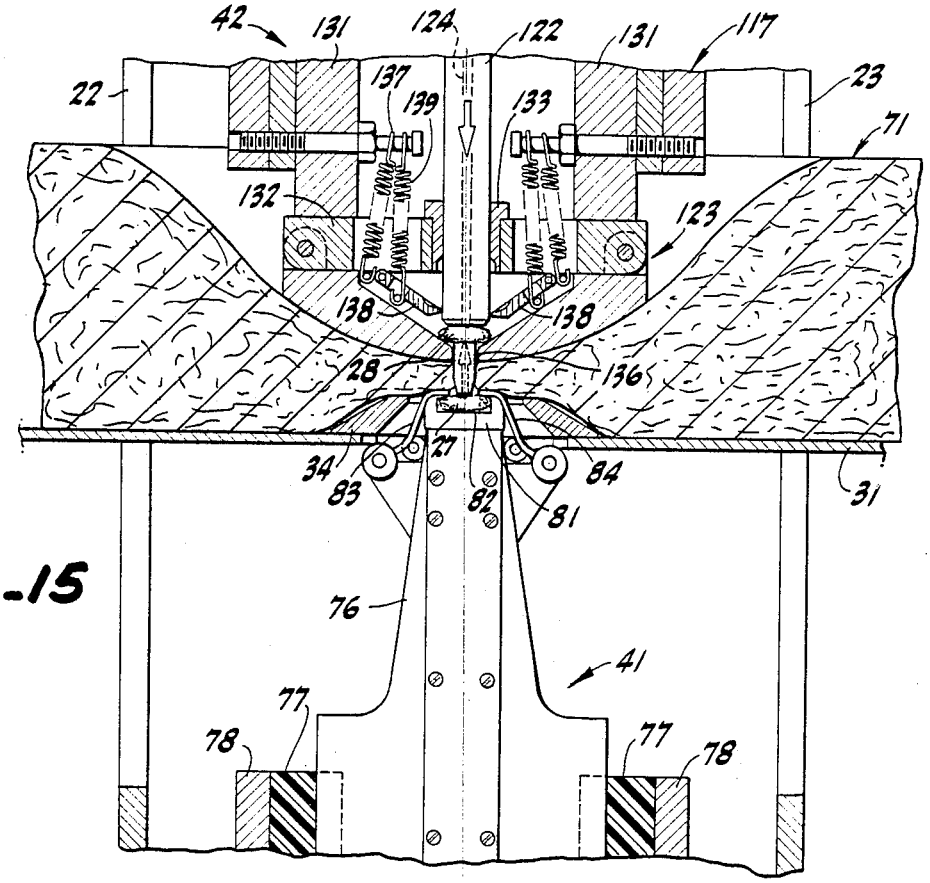

The lower drive plate 76 is then driven upwardly by the vertical drive cylinder 79 so as to move the male button part 27 upwardly for extension of the shank thereof through the aperture in the cushion previously formed by the needle 51. The spring clips 83 and 84 hold the button part with the shank in alignment with the drive axis 32 during this operation. The male button part is thus firmly retained atop the drive plate 76 with the shank thereof extending through the cushion in position for attachment of the female button thereto, as shown in FIG. 14. The upper drive rod 122 is then driven downwardly by actuation of the drive cylinder 121 so that the rod 122 slides through the collar 133 to force the female button 28 downwardly. The support plates 138 are pivoted downwardly, as indicated in FIG. 15, and the female button part is forcibly driven onto the upstanding male button part so that the shank of the latter penetrates the hollow female button shank to lock the two button parts together.

The foregoing steps of operations complete a single application of a tufting button to a cushion, and upper and lower drive mechanisms are then returned to original position by operating the drive cylinders 79, 118 and 121 for retracting the piston rods thereof. This return operation may be initiated by valves operated by an arm extending laterally from the drive rod 122, for example, so that as soon as the button parts are locked together the drive mechanism retracts. This retraction is illustrated in FIG. 16, wherein the drive rod 122 is shown to be raised upward to its normal position, and the upper slide frame 117 is being withdrawn upwardly so that the jaws 134 of the jaw mechanism 123 pivot outward to pass about the head of the female button part and the male button part is drawn upwardly by connection to the female button part as the cushion 71 returns to normal position as the jaws 134 are retracted upwardly. Note that the spring clips 83 and 84 are forced apart by the male button head as they are retracted with the drive plate 76 and then are pulled together as shown in FIG. 16 until the drive plate is retracted to force the clips apart by engagement of rods 88 and posts 89.

The tufting machine returns to original position whereat the upper and lower feed means deposit female and male button parts in position to be driven and the yoke 63 of the needle drive assembly 43 is pivoted downwardly against the force of the spring 64 so that the machine is ready for another tufting operation. The cushion 71 on the table 31 is then manually or otherwise moved to a desired position wherein the drive axis 32 extends through a desired button location on the cushion for the next button insertion. Actuation of the tufting machine may, for example, be initiated by a foot peddle causing the machine to go through a cylce of operation as described above. Relatively conventional pneumatic valving with appropriate actuators may be employed to complete an automated cycle of operation.

Certain types of cushions or pads that may be tufted contain fiberous material 72 which tends to rapidly expand into the aperture formed by the drive needle 51. In order to accommodate tufting of cushions or pads having such a filler 72, there may be provided an alternative jaw mechanism 123 having particularly configured jaws 134 in order to accommodate the use of a substantially larger diameter needle than normal for producing a bigger aperture that will not be closed by the filler material expanding as the needle is withdrawn. In this respect reference is made to FIGS. 17A and 17B, wherein each of the jaws 134 is shown to have a longitudinal bore or recess 206 extending inwardly from the facing portions of the jaws. A slide block 207 is disposed in each of the these bores 206, and backed by a small spring 208 so that the slide block may be resiliently pressed into the bores to increase the size of an opening 209 between the facing edges of the jaws 134. The upper surfaces of the jaws 134 are cut out as indicated at 211 to receive the head of a female button, and the slide block 206 is retained in the recess of the jaw by a pin 212 extending from each of the slide blocks 207 through small apertures 213 in the jaws. This then retains the slide block in the jaws and allows limited displacement of the blocks further into the recesses.

Operation of this particular jaw mechanism allows the use of an oversized needle 51. Referring to FIG. 17A, it will be seen that, as this larger needle is driven upwardly between the jaws 134 the tapered end of the needle will engage the slide blocks 207, and resiliently force them further into the recesses 206. Upon retraction of the needle 51, the slide blocks will return to normal position as dictated by the pins 212 in the small slots 213, as shown in FIG. 17B. The opening between the slide block of the jaws will then be the correct size to accommodate insertion of the male and female button parts and to maintain same in alignment along the drive axis 32. It is noted in this respect that the configuration of the lower surfaces of the jaws 134 is not critical, and thus they may, for example, be curved as illustrated in FIG. 12 and the like of drawings or may merely be tapered or conical as indicated in FIGS. 17A and 17B. It is also noted that the slide blocks may be of cylindrical shape to slidably engage cylindrical bores 206 of the jaws with the pin and slot arrangement being provided to prevent angular displacement of the slide blocks in order to maintain the axial opening between the facing portions of the jaws 134. By the use of an oversized needle 51 having a greater diameter than the aperture required through the cushion, it is possible to tuft cushions having filler material that tends to expand into the aperture formed by the needle 51, and yet to retain a sufficient aperture for insertion of button parts.

There has been described above an improved tufting machine capable of rapidly and efficiently inserting upholstered button parts in a pad or cushion, and locking together such parts for completion of tufting operations. The basic button parts employed herein are the same as those described in my above noted patent with the addition of upholstery material covering the heads of the male and female button parts. Upholstery of the heads of tufting buttons is accomplished in conventional manner, which includes the provision of a thin metal sheet over the head of each button part together with any desired type of upholstery material over the metal sheet, with all being crimped together under the head of the button. In part because of the nature of upholstery material, there are encountered various problems as described above, with respect to feeding and inserting upholstered button parts for tufting operations. The present invention provides particular structure and systems for overcoming these problems and rapidly driving and engaging button parts through pads, cushions or the like to complete tufting operations. Extremely rapid tufting operations are possible with the present invention, and particular provisions are made herein for preventing operations of the machine with faulty or misaligned button parts, together with provision for removing such button parts. It will thus be seen that the present invention provides a material improvement in the field of tufting machines wherein effficient and high speed tufting operations may be performed with upholstered buttons.

Although the present invention has been described above with respect to a particular preferred embodiment of the present invention, it will be apparent to those skilled in the art that numerous modifications and variations may be made within the scope of the present invention, and thus, it is not intended to limit the invention to precise terms of description or details of illustration.

What is claimed is:

1. A tufting machine for inserting a two part upholstered button with interlocking male and female button parts in a workpiece comprising a table for receiving a workpiece to be tufted and having an aperture therethrough about a drive axis of the tufting machine, a retractable needle drive mechanism having means to move a needle into alignment with a drive axis which projects through the aperture in said table and said needle being movable through said aperture along said drive axis to create a gap in said workpiece, a male button driver having means for holding a male button part on a drive plate and moving said drive plate between a retracted and extended position for driving a shank of said part through said aperture and through the gap in said workpiece, a male feed mechanism feeding successive male button parts onto said male button driver in a retracted position, a jaw mechanism having pivotal jaws and movable to compress a workpiece on said table at the aperture therethrough, a female button driver having means for holding a female button part and movable between a retracted and extended position for driving a female button part through said jaws onto a male button part extending through said gap in said workpiece, and a female button feed mechanism extending to said female button driver for feeding successive female button parts into said female button driver in a retracted position.

2. The machine of claim 1 further defined by said male and female button feed mechanisms each having gate units operating to pass individual button parts in spaced relation onto paths leading to the button drivers for preventing contact of button parts moving along the majority of such paths.

3. The machine of claim 1 further defined by said needle drive mechanism comprising a plate slidably disposed between movably mounted arms and carrying a needle on an outer end of said plate, a first cylinder connected to slidably extend and retract said plate and needle into and out of alignment with said drive axis, and a second drive cylinder connected to said movable arms for driving said needle substantially along said drive axis to pierce a workpiece on said table and to retract therefrom.

4. The machine of claim 3 further defined by a spring loaded member normally positioned in front of said slide plate to prevent movement of the plate from a retracted position and means connecting said member to said male button driver for moving said member away from said slide plate in retracted position of said male button driver to free the needle drive mechanism for operation.

5. The machine of claim 3 further defined by said needle drive mechanism being disposed beneath said table above said male button driver and laterally displaced therefrom with respect to said drive axis.

6. The machine of claim 1 further defined by said male button driver including a drive plate slidably disposed between vertical rails beneath said table, a drive cylinder connected to said drive plate for moving said plate between said extended and retracted positions, said drive plate having an indented top for receiving a single male button part with a shank thereof extending upwardly along said drive axis, and spring clips resiliently movable into clamping relation to the head of a male button part in said drive plate indentation for holding male button part in alignment with said drive axis and in extension through a workpiece for holding the male button part during attachment with a female button part and release of the male button part upon retraction of said drive plate.

7. The machine of claim 6 further defined by means sensing the presence of a male button part in the indentation in said drive plate and the alignment of the shank thereof with said drive axis in retracted position of said drive plate for producing an enabling signal for said machine.

8. The machine of claim 1 further defined by said male button feed mechanism comprising a vibratory hopper adapted to contain button parts and to feed same therefrom with the shanks thereof extending upwardly from the heads, a lower button track including means defining a male button path including an inverted T-shaped slot leading to said male button driver, air jet means directing jets of air at an angle onto said lower button track for urging male button parts to move therealong onto said male button driver, and a gate disposed between said vibratory hopper and said lower track for releasing male button parts individually onto said track to move in spaced relation therealong.

9. The machine of claim 2 further defined by said gate means each comprising a wire having offset parallel portions joined by a U-shaped portion and disposed at the start of paths of button parts to said drivers, and means moving said wires back and forth longitudinally of said button paths for retaining button parts thereat and releasing a single button part for each back and forth movement, whereby button parts are fed to said paths in spaced relation to each other.

10. The machine of claim 1 further defined by said female button driver comprising a slide frame controllably movable toward and away from said table and having a lower jaw mechanism including a pair of pivotal jaws having a small opening therebetween, means for moving said slide frame for forcing said jaws into compressing relation to a workpiece disposed on said table whereby said needle pierces said workpiece upon actuation of said needle drive mechanism.

a drive rod mounted for movement along said drive axis in said slide frame, and drive means mounted on said slide frame and engaging said drive rod for extending and retracting same to drive the shank of a female button part through an aperture in a workpiece on said table wherein prior actuation of said male button driver has disposed the shank of a male button part whereby the hollow shank of a female button part is driven onto a male button shank for locking engagement of said button parts through a workpiece.

11. The machine of claim 10 further defined by said jaw mechanism having a collar with a cut out lower end for receiving the head of a female button part and disposed about the lower end of said drive rod in slidable relation thereto, a pair of pivotally mounted support plates defining a slot partially through contiguous edges thereof for receiving the shank of a female button part having the head thereof resting on said plates, and a magnet mounted in said collar for attracting and holding a female button part by attraction of metal in an upholstered head thereof in the cut out of said collar with the button shank aligned with said drive axis.

12. The machine of claim 1 further defined by said female button feed mechanism comprising means feeding female button parts in a line onto a chute with each part resting on the head thereof and the shank extending upwardly, a track including three rods spaced apart in a triangular array with first and second rods being separated less than the diameter of a female button part head, said first and second and third rods extending to said chute in engagement above and being twisted through 180° in extension therefrom whereby a button part moving along said track from said chute is inverted so that the shank thereof depends downwardly between said first and second rods, and said first and second rods being disposed on opposite sides of the shanks of button parts on said chute and said third rod being disposed at the bottom of said chute, whereby said twisted rods support the head of button parts on said first and second rods with said third rod disposed immediately above the head of such button parts for retaining said button parts on said track.

13. The machine of claim 12 further defined by a vibratory hopper feeding female button parts into said chute that is connected thereto, and said track comprising a first twisted portion connected to said chute to vibrate therewith for moving button parts therealong and a second portion inclined downwardly from said first portion with rods of said first and second portions being slightly separated whereby button parts slide down said second portion of said track by gravity.

14. The machine of claim 12 further defined by said track extending outward and inclined downward from said chute to a substantially horizontal portion leading to said female button driver for delivering female button parts thereto in proper orientation to be driven by said female button driver.

15. The machine of claim 13 further defined by a gate disposed adjacent said track at the start of said downward portion and having a gate member movable laterally across said track beneath same with laterally offset portions engaging depending shanks of button parts for releasing button parts individually and moving successive button parts into release position for each lateral movement of said gate member whereby button parts slide down said track in spaced-apart relation.

16. The machine of claim 14 further defined by said track having said first and second rods thereof extending to a jaw mechanism of said female button driver and said third rod extending into a longitudinal slot in a drive rod of said female button driver for disposing female button parts into position for driving by said female button driver.

17. The machine of claim 16 further defined by a fixed upper mount for the inclined portion of said track and a spring loaded mounting means for said track adjacent the bottom of the inclined portion thereof whereby said track may be pivoted downwardly a limited amount by resiliency of said track rods.

18. The machine of claim 14 further defined by track spacers having a central opening and a lower cut out leading thereto for diposition about said track rods with said first and second wires secured to each spacer in said cut out for maintaining the separation of said track rods, and said track spacers being disposed at spaced intervals along said track.

19. The machine of claim 11 further defined by said drive rod having a longitudinal slot therein extending through the bottom end of said rod, and said upper feed mechanism including a track having three rods laterally disposed in a triangular array with the lower pair of rods extending to said support plates and said upper rod extending into said longitudinal slot in said drive rod for retaining a female button part in position to be driven by said female button driver.

20. The machine of claim 1 further defined by said table having an apertured frustoconical extension upwardly thereon about said drive axis, and a further aperture offset from said drive axis, and sensing means including a light source and photocell having a line of sight through said further table aperture for producing a signal indicating the presence or absence of a workpiece on said table.

* * * * *